US008976078B2

(12) United States Patent
De Rosny et al.

(10) Patent No.: US 8,976,078 B2
(45) Date of Patent: Mar. 10, 2015

(54) DEVICE FOR RECEIVING AND/OR EMITTING AN ELECTROMAGNETIC WAVE, SYSTEM COMPRISING SAID DEVICE, AND USE OF SUCH DEVICE

(75) Inventors: Julien De Rosny, Nogent sur Marne (FR); Geoffroy Lerosey, Paris (FR); Arnaud Tourin, Serves (FR); Mathias Fink, Meudon (FR); Fabrice Lemoult, Paris (FR)

(73) Assignees: Time Reversal Communications, Cergy Pontoise Cedex (FR); Centre National de la Recherche Scientifique—CNRS, Paris (FR)

( * ) Notice: Subject to any disclaimer, the term of this patent is extended or adjusted under 35 U.S.C. 154(b) by 518 days.

(21) Appl. No.: 13/505,943

(22) PCT Filed: Nov. 9, 2010

(86) PCT No.: PCT/EP2010/067104

§ 371 (c)(1),
(2), (4) Date: Jul. 24, 2012

(87) PCT Pub. No.: WO2011/054963

PCT Pub. Date: May 12, 2011

(65) Prior Publication Data

US 2012/0280886 A1 Nov. 8, 2012

(30) Foreign Application Priority Data

Nov. 9, 2009 (WO) ..... PCT/IB2009/056039

(51) Int. Cl.
*H01Q 15/00* (2006.01)
*H01Q 3/44* (2006.01)

(Continued)

(52) U.S. Cl.
CPC ..... *H01Q 15/0006* (2013.01); *H01Q 15/0086* (2013.01); *H01Q 15/00* (2013.01); *H01Q 3/44* (2013.01); *H01Q 3/446* (2013.01); *H01Q 15/10* (2013.01); *H01Q 25/00* (2013.01)
USPC ..... 343/909; 343/911 R; 343/893; 343/754

(58) Field of Classification Search
CPC ... H01Q 15/00; H01Q 15/0086; H01Q 15/10; H01Q 3/44
USPC ..... 343/908, 909, 911 R
See application file for complete search history.

(56) References Cited

U.S. PATENT DOCUMENTS 7,236,138 B2 * 6/2007 Wang ..... 343/754
7,522,105 B1 * 4/2009 LaComb ..... 343/700 MS (Continued)

FOREIGN PATENT DOCUMENTS

WO WO 01/71774 9/2001
WO WO 2008/007024 1/2008
WO WO 2010/065555 6/2010

OTHER PUBLICATIONS

International Search Report dated May 18, 2010 for Application No. PCT/IB2009/056039.

(Continued)

*Primary Examiner* — Dameon E Levi
*Assistant Examiner* — Jennifer F Hu
(74) *Attorney, Agent, or Firm* — Frost Brown Todd LLC

(57) ABSTRACT

A device for receiving and/or emitting an electromagnetic wave having a free space wavelength $\lambda_0$ comprised between 1 mm and 10 cm, comprising a medium (11) of solid dielectric material and the free space wavelength $\lambda_0$ corresponding to a wavelength $\lambda$ inside the medium, a plurality of conductor elements (12) incorporated inside the medium and spaced apart from each other of a distance lower than $\lambda/10$, and one antenna element (13). The conductor elements are not loop elements. A tuned conductor element among the conductor elements has a first end at a distance from the antenna element which is lower than $\lambda/10$, and has a length $H_{wire}$ adapted to generate an electromagnetic resonance in the tuned conductor element corresponding to the wavelength $\lambda$.

20 Claims, 5 Drawing Sheets

(51) Int. Cl.
*H01Q 15/10* (2006.01)
*H01Q 25/00* (2006.01)

(56) References Cited

U.S. PATENT DOCUMENTS

| | | | | |
|---|---|---|---|---|
| 8,102,328 | B2 | 1/2012 | Fink et al. | |
| 2001/0038325 | A1* | 11/2001 | Smith et al. | 333/202 |
| 2003/0227415 | A1* | 12/2003 | Joannopoulos et al. | 343/754 |
| 2008/0088524 | A1* | 4/2008 | Wang et al. | 343/909 |
| 2009/0040132 | A1* | 2/2009 | Sridhar et al. | 343/911 R |

OTHER PUBLICATIONS

International Search Report dated Jan. 18, 2011 for Application No. PCT/EP2010/067143.

Erentok, A., et al. "Characterization of a Volumetric Metamaterial Realization of an Artificial Magnetic Conductor for Antenna Applications", IEEE Transactions on Antennas and Propagation, IEEE Service Center, Piscataway, NJ, US, Jan. 2005, vol. 53, No. 1, pp. 160-172.

Fink, M., et al., "Time-reversed waves and super-resolution", Comptes Rendus, Physique, Elsevier, Paris, FR, vol. 10, No. 5, pp. 447-463.

Lemoult, F., et al., "Resonant Metalenses for Breaking the Diffraction Barrier", The American Physical Society, May 21, 2010, No. 104, pp. 203901-1-203901-4.

Mosallaei, H., et al. "Design and Modeling of Patch Antenna Printed on Magneto-Dielectric Embedded-Circuit Metasubstrate", IEEE Transactions on Antennas and Propagation, Jan. 2007, vol. 55, No. 1, pp. 45-52.

Shvets, G., et al., "Guiding, Focusing, and Sensing on the Subwavelength Scale Using Metallic Wire Arrays", The American Physical Society, Aug. 3, 2007, No. 99, pp. 053903-1-053903-4.

* cited by examiner

DEVICE FOR RECEIVING AND/OR EMITTING AN ELECTROMAGNETIC WAVE, SYSTEM COMPRISING SAID DEVICE, AND USE OF SUCH DEVICE

FIELD OF THE INVENTION

The present invention concerns a device for receiving and/or emitting an electromagnetic wave, a system comprising said device, and a use of such device.

BACKGROUND OF THE INVENTION

It is known from the applicant's own patent application WO 2008/007024, a device having a reactive type antenna element surrounded by a plurality of metallic diffusers. Thanks to this arrangement, the electromagnetic wave is focused to a point i near the antenna element at a sub wavelength distance.

This device is efficient, but still need to be improved.

OBJECTS AND SUMMARY OF THE INVENTION

One object of the present invention is to provide an improved device for receiving and/or emitting an electromagnetic wave.

To this effect, the device proposes a device for receiving and/or emitting an electromagnetic wave having a free space wavelength $\lambda_0$ comprised between 1 mm and 1 m, comprising:

- a medium of solid dielectric material having at least a substantially plane first surface, the free space wavelength $\lambda_0$ corresponding to a wavelength $\lambda$ inside said medium (11),
- a plurality of conductor elements incorporated inside said medium, each conductor element being a wire of a predetermined length extending along a direction intersecting said first surface, between a first end in proximity to said first surface and a second end away from said first surface, and two neighbour conductor elements being spaced apart from each other of a distance lower than $\lambda/10$, wherein the second end being distant from the first end of an ends distance higher than $\lambda/10$, and wherein the conductor elements comprises a first point and a second point that are distant from each other of a curvilinear distance along the conductor element higher than $\lambda/4$, said first and second point being also distant from each other of a straight line distance higher than $\lambda/10$,

- at least one antenna element intended to be connected to an electronic device for receiving or emitting an electric signal representative of said electromagnetic wave, wherein at least one tuned conductor element among the conductor elements has its first end at a distance from said antenna element which is lower than $\lambda/10$, and said tuned conductor element has a length $H_{wire}$ adapted to generate an electromagnetic resonance along said tuned conductor element corresponding to said wavelength $\lambda$.

Thanks to these features, the device comprises a tuned conductor element having an electromagnetic resonance in coincidence to a transverse electromagnetic mode (TEM) of the medium incorporating said conductor elements (a wire medium). The device is therefore able to receive or emit efficiently an electromagnetic wave, and such device is extremely compact in size. It is compact in size along transversal or lateral directions X, Y perpendicular to the direction D.

In various embodiments of the device, one and/or other of the following features may optionally be incorporated:-a plurality of transverse electromagnetic modes inside the medium have electric and magnetic vectors extending along said first surface, and have a propagation vector extending along the direction, and the plurality of transverse electromagnetic modes have a medium resonance frequency corresponding to said wavelength $\lambda$;

- the antenna element is positioned proximal to at least one antinode of the transverse electromagnetic modes of the medium;
- the device comprises another antenna element intended to be connected to the electronic device for receiving or emitting another electric signal, the other antenna element being different than the antenna element, and the other electric signal being different than the electric signal, and the tuned conductor element has its first end at a distance from said other antenna element which is lower than $\lambda/10$;
- the antenna element is positioned proximal to at least one antinode of the transverse electromagnetic modes of the medium and the other antenna element is positioned proximal to at least another antinode of the transverse electromagnetic modes of the medium, the antinode and other antinode belonging to different modes of the transverse electromagnetic modes;
- the antenna element is one of the conductor elements;
- the antenna element is a conductor of an electronic board substantially in close proximity with said first surface;
- the length $H_{wire}$ is between $0.7 \cdot N \cdot \lambda/2$ and $N \cdot \lambda/2$, where N is a natural integer;
- the length $H_{wire}$ is substantially equal to $N \cdot \lambda/2$, where N is a natural integer;
- the device further comprises another tuned conductor element among the conductor elements, the other tuned conductor element being different than the tuned conductor element, and the other tuned conductor element has its first end at a distance from said antenna element which is lower than $\lambda/10$, and said other tuned conductor element has another length $H_{wire}$* adapted to generate an electromagnetic resonance along said other tuned conductor element corresponding to another wavelength $\lambda$*, the other wavelength $\lambda$* being different than the wavelength $\lambda$, so that said antenna element is able to receive and/or emit simultaneously electromagnetic waves of said wavelength $\lambda$ and of said other wavelength $\lambda$*;
- the direction is a straight line, so that the active conductor element is a linear wire extending along the direction;
- the medium comprises a second surface, said second surface being substantially plane, intersecting said direction and not being parallel to said first surface, so that said medium has a bevel shape and the conductor elements incorporated inside said medium have a plurality of lengths adapted to a range of wavelengths;
- the direction is an arched direction between said first surface and said second surface, and comprising a centre of arc, so that the conductor elements that are near said centre of arc have a shorter length than the other conductor elements;
- the device further comprises another tuned conductor element among the conductor elements, the other tuned conductor element being different than the tuned conductor element, and the other tuned conductor element has its first end at a distance from said antenna element which is lower than $\lambda/10$, and the other tuned conductor element comprises a dielectric layer covering said other tuned conductor element adapted to generate an electromagnetic resonance along said other tuned conductor element corresponding to another wavelength $\lambda^*$, the other wavelength $\lambda^*$ being different than the wavelength $\lambda$, so that said antenna element is able to receive and/or emit simultaneously electromagnetic waves of said wavelength $\lambda$ and of said other wavelength $\lambda^*$;

the medium comprises holes modifying the refractive material index of the medium;

the first ends of the conductor elements are regularly spaced inside said first surface, forming a periodic pattern inside said first surface;

the medium further comprises lateral surfaces extending around said medium from the first surface and substantially along the direction, and wherein said lateral surfaces are covered with a conductive material;

each first end of the conductor element is connected to an electric charge chosen in the list of an electric mass, a constant electric potential, a passive impedance, a resistance impedance, a capacitor impedance, and an inductor impedance;

the curvilinear distance is higher than $\lambda/2$.

Another object of the present invention is to provide a system comprising a device for receiving and/or emitting an electromagnetic wave, wherein the antenna element is connected to an electronic device for receiving and/or emitting an electric signal representative to said electromagnetic wave.

Another object of the present invention is to use a device for receiving and/or emitting an electromagnetic wave having a free space wavelength $\lambda$ comprised between 1 mm and 1 m, and preferably between 10 cm and 40 cm.

BRIEF DESCRIPTION OF THE DRAWINGS

Other features and advantages of the invention will be apparent from the following detailed description of six of its embodiments given by way of non-limiting example, with reference to the accompanying drawings.

In the drawings.

MORE DETAILLED DESCRIPTION

In the various figures, the same reference numbers indicate identical or similar elements. The direction Z is a vertical direction. A direction X or Y is an horizontal direction.

Figure 1:
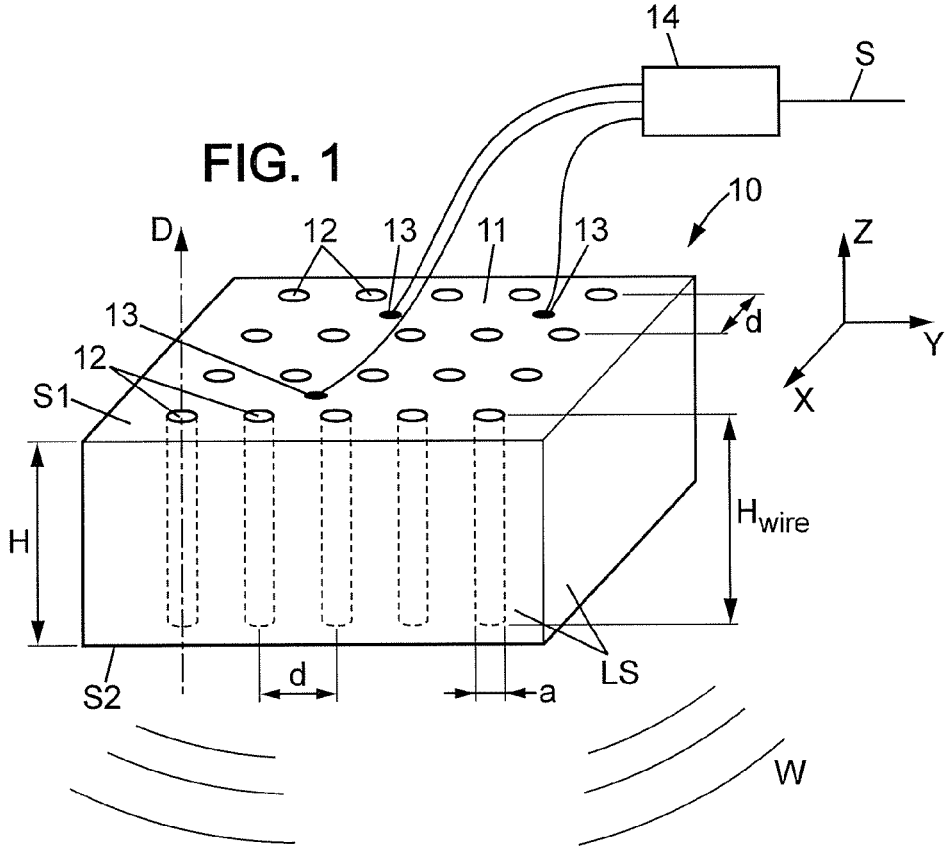
FIG. 1 is perspective view of a device for receiving or emitting an electromagnetic wave according to the invention.

The FIG. 1 represents a first embodiment of a device 10 for receiving or emitting an electromagnetic wave W in a space and having a free space wavelength $\lambda_0$ comprised between 1 mm and 1 m, and preferably between 10 cm and 40 cm.

This device comprises:

a medium 11 of solid dielectric material, a plurality of conductor elements 12, that are wires incorporated inside said medium 11, and an antenna element 13 intended to be connected to an electronic device 14 for receiving or emitting an electric signal S representative of said electromagnetic wave W.

The medium has a refractive index $n_d$.

The space may be air and is considered to have a refractive index equal to one.

The free space wavelength $\lambda_0$ corresponds to a wavelength $\lambda$ inside the medium 11 with the following relation: $n_d \cdot \lambda = \lambda_0$.

The medium 11 has a parallelepiped shape, comprising a first surface S1 and a second surface S2, opposite to said first surface along the vertical direction Z. The first and second surfaces S1, S2 are substantially parallel planes. A direction D is substantially a straight line perpendicular to said surfaces and parallel to the vertical direction Z. The first and second surfaces S1, S2 are distant of a height value H.

The medium has an electric permeability of $\epsilon_d$.

The conductor elements 12 are circular wires of diameter and extending along said direction D. These conductor elements 12 have a first end 12*a* on said first surface S1 and a second end 12*b* on said second surface S2. Each conductor element 12 has a length of the same value H. In this first embodiment the conductor elements 12 form on the first surface S1 or any plane XY perpendicular to said vertical direction Z a regularly spaced square grid. The conductor elements 12 are parallel to each other along the vertical direction Z and are spaced from each other along the direction X or Y of a distance d lower than $\lambda/10$. This sub-wavelength distance d is the step of said grid. The conductor elements 12 form therefore a regular lattice of wires.

One or several antenna elements 13 are installed on said first surface S1 or said second surface S2 or both of them. The antenna elements 13 may be fed with a single electric signal S to emit or receive a single electromagnetic wave W, or they may be fed with a plurality of electric signals to emit or receive simultaneously a plurality of electromagnetic waves.

In such wire medium comprising wire conductor elements 12 embedded inside a medium 11, the magnetic field vector B and the electric field vector E are perpendicular to said direction D, and the propagation wave vector K is a propagation vector collinear to said direction D. The electromagnetic wave W is a plane wave propagating inside the medium 11 along the direction D.

Figure 2A:
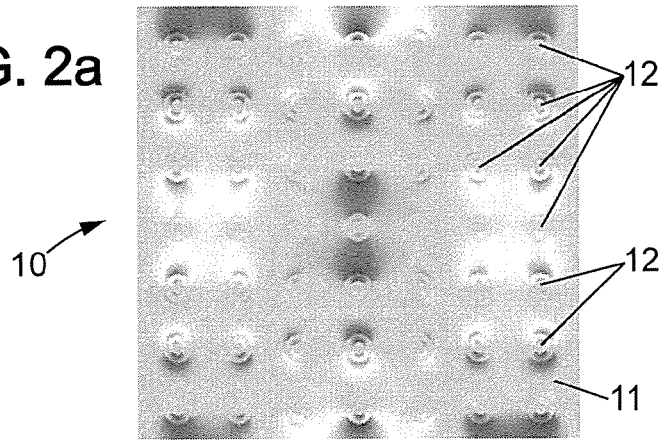
FIGS. 2*a*, 2*b* and 2*c* are three views of three transverse electromagnetic modes inside the device of FIG. 1.
Figure 2B:
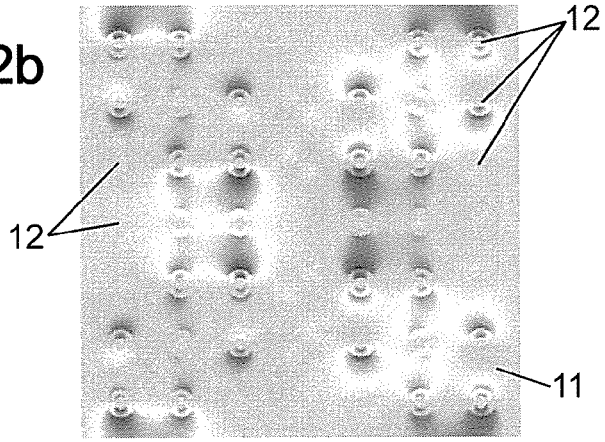
Figure 2C:
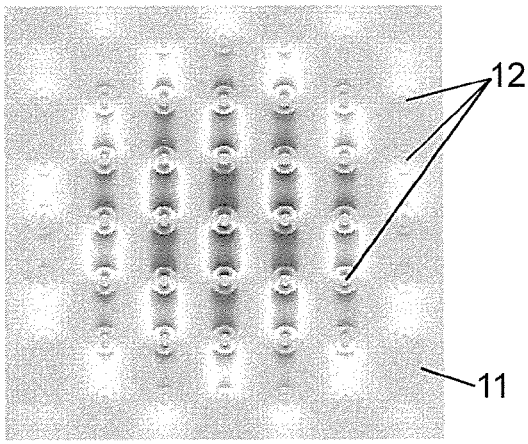

The magnetic field vector B and electric field vector E have transverse electromagnetic modes TEM inside said medium 11, with nodes and antinodes. These TEM modes have sub-wavelengths variations along directions X and Y. FIGS. 2*a*, 2*b* and 2*c* represent the amplitude variations of the electric field vector E inside the medium 11 according three different modes, wherein the medium 11 incorporates 7×7 conductor elements 12. Each mode has a different pattern inside the medium 11 and is orthogonal to the other modes. Thanks to this physical property of diversity, the electric signals of a plurality of antenna elements 13 at the boundary of the medium 11 are uncorrelated to each other. These antenna elements 13 may be used independently from each other or may be used in a multi-input multi-output (MIMO) configuration. Moreover, this plurality or array of antenna is an extremely compact device in size.

The wire medium is a non dispersive medium and the dispersion relation is:

$$\omega = k_z \cdot c / n_d,$$

where:

$k_z$ is the Z component value of the propagation wave vector K, c is the electromagnetic wave speed in vacuum, $n_d$ is the refractive index of the medium material.

For example, the refractive index of air is 1 and the refractive index of epoxy is around 2.

The medium 11 is therefore an anisotropic medium. Each TEM mode has the same propagation speed and the same resonance frequency f, $f=\omega/(2\cdot\pi)$.

All or part of the conductor elements 12 of the medium 11 can be tuned to this resonance frequency f. The conductor elements 12 may have a specific length $H_{wire}$ between $0.7\cdot N\cdot\lambda/2$ and $N\cdot\lambda/2$, where:

N is a natural integer, and $\lambda$ is the wavelength inside the medium.

More precisely, the conductor elements 12 may have a specific length $H_{wire}$ of:

$$H_{wire} = N\cdot\lambda/2.$$

The tuned conductor elements 12 have therefore a resonance frequency in coincidence with the resonance frequency of the TEM modes.

Thanks to this tuning, the TEM modes may excite or may be excited by most of the conductor elements 12 incorporated inside the medium 11.

Advantageously, the antenna element 13 may be positioned proximal to at least one antinode of the transverse electromagnetic modes of the medium 11. This may improve the device sensivity to receive and/or emit the electromagnetic wave.

A plurality of antenna elements 13 may be implemented inside the device. Each antenna element 13 of this plurality may be positioned proximal to a different antinode of the transverse electromagnetic modes TEM. Each antenna element 13 is then fed with a single electric signal S. Then, a plurality of modes belonging to the TEM modes are excited and more conductor elements 12 contribute to receive and/or emit the electromagnetic wave W. By this way, the radiation diagram of the device may be affected.

A plurality of antenna elements 13 may be implemented inside the device. Each antenna element 13 of this plurality may be positioned proximal to a different antinode of the transverse electromagnetic modes TEM. Each antenna element 13 may be fed with a different electric signal S. By this way, the device can receive and/or emit a different and independent electromagnetic waves W, simultaneously.

In a first variant, the antenna element 13 may be simply one of the conductor elements 12 of the wire media that is connected to the electronic device 14.

In a second variant, the antenna element 13 is a conductor patch or wire above an electronic board, said electronic board being in close proximity with the first surface S1 and/or second surface of the medium 11.

In various embodiments, it is possible to generate inside said medium TEM modes with different resonant frequencies.

Figure 3:
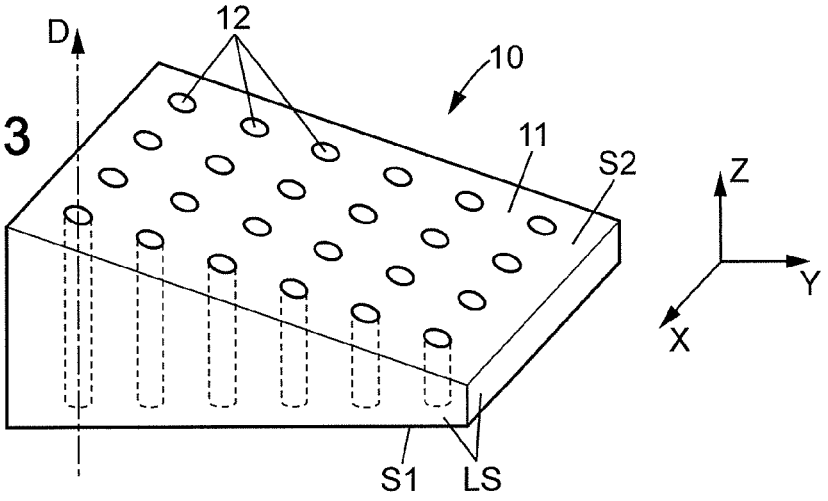
FIG. 3 is a second embodiment of the invention comprising a medium having a bevel shape.

In a second embodiment shown on FIG. 3, the wire medium described above is cut along a plane not parallel to said first surface S1, to form a bevel shape. The conductor elements 12 incorporated in such medium have a plurality of lengths between $H_{wire,\,min}$ to $H_{wire,\,max}$, $H_{wire,\,min}$ corresponding to the height of the lowest portion of the medium and $H_{wire,\,max}$ corresponding to the height of the highest portion of the medium. The device is then adapted to a predetermined range of wavelengths corresponding to this range of heights.

Figure 4:
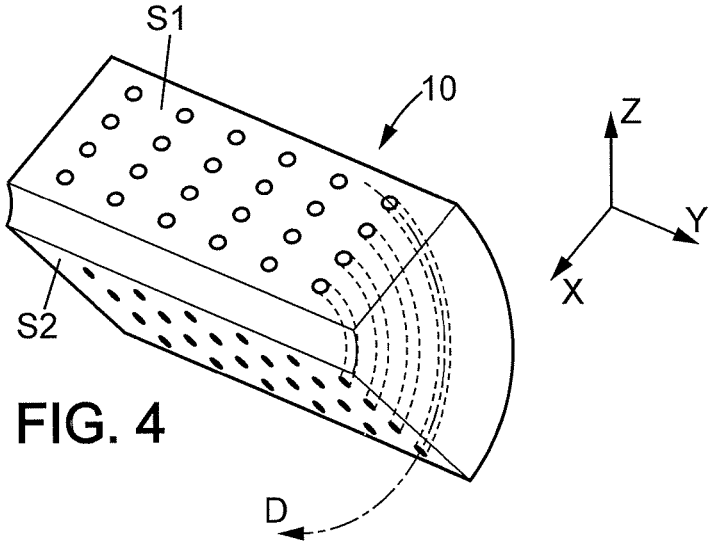
FIG. 4 is a third embodiment of the invention comprising a medium having an arched shape.

In a third embodiment shown on FIG. 4, the direction D is an arched direction between said first surface S1 and said second surface S2. For example, the medium is made of flexible sheets having conductor stripes on each of them, these sheets being arched and stacked together. The conductor stripes (conductor elements) 12 near the centre of arc or with a short radius are shorter than the conductor stripes with a longer radius.

Figure 5:
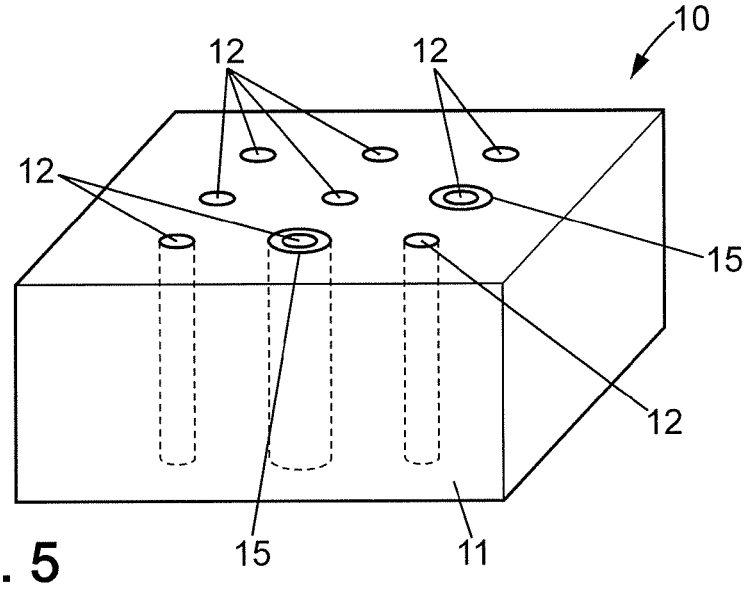
FIG. 5 is a fourth embodiment of the invention comprising a dielectric layer surrounding some conductor elements of the device.

In a fourth embodiment shown on FIG. 5, some of the conductor elements 12 have a dielectric layer 15 covering said conductor elements. The dielectric layer 15 has an electric permeability of $\epsilon_{layer}$ different than the electric permeability $\epsilon_d$ of the medium 11. The resonant frequency of the conductor elements 12 covered with said dielectric layer 15 is different than the resonant frequency of the conductor elements 12 without said layer 15.

Figure 6:
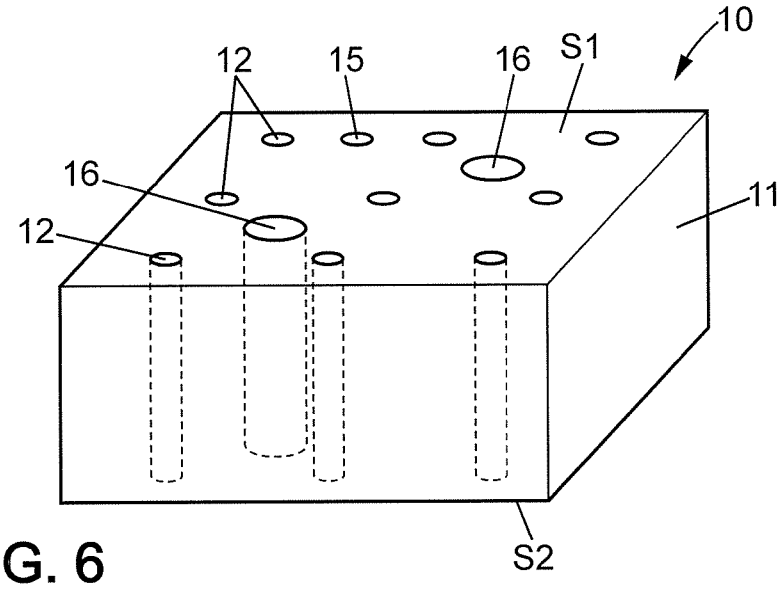
FIG. 6 is a fifth embodiment of the invention comprising holes inside the medium of the device.

In a fifth embodiment shown on FIG. 6, the medium 11 is bored to form holes 16. The holes are modifying the refractive index $n_d$ of the medium 11 near predetermined conductor elements 12.

Figure 7:
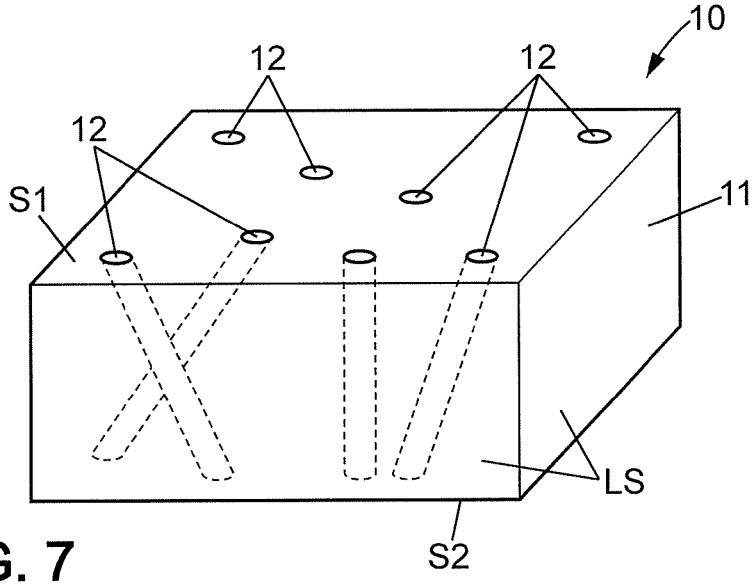
FIG. 7 is a sixth embodiment of the invention having non parallel conductor elements.

In a sixth embodiment shown on FIG. 7, the conductor elements 12 are not parallel to each other. The lengths of the conductor elements 12 vary inside the medium 11.

Moreover, contrary to the previous embodiments, the conductor elements 12 do not form a periodic pattern along the first surface S1.

Thanks to the five previous various embodiments, the medium 11 comprises several resonant frequencies and the device for receiving or emitting an electromagnetic wave may have an enlarged bandwidth.

Additionally and according more variants:

- lateral surfaces LS of the medium may be covered with a conductive material,
- the first surface may have a ground plane,
- the conductor elements 12 may form loop shapes, or curvilinear shapes,
- the antenna elements 13 may be a monopole, or a dipole,
- the antenna elements 13 may be wires shorter than the wavelength or longer than the wavelength.
- the antenna elements 13 may be incorporated inside the medium 11, or along the first surface S1 or along the first and second surfaces S1, S2.

The present invention device 10 may be manufactured by known methods. For example, multilayer copper etching above epoxy material may be used, each layer comprising a plurality of conductor elements inside the plane of the layer.

In all the embodiments of the invention, illustrated in FIGS. 1 to 7, the conductor elements 12 do not form a loop.

A loop conductor element is an electric inductance.

Such loop conductor element can be associated with a capacitive element to behave as an electric LC resonator, receiving or emitting a magnetic field.

In such case, an ends distance between the first and second ends belonging to a conductor element 12 is lower than $\lambda/10$.

Such conductor element 12 forming a loop, is often called a split ring element, or a capacitively loaded loop, or an artificial magnetic conductor.

A device for receiving and/or emitting an electromagnetic wave using such electric loops is generally flat, and generally has a large size in the transversal or lateral directions X, Y.

The conductor elements 12 of present patent application do not have such global electric behaviour. The conductor elements 12 are mainly linear wires that may be arched. They have an electromagnetic resonance along their length, receiving or emitting an electric field.

The conductor elements 12 are not forming a loop adapted to generate a magnetic field oscillating at the wavelength λ.

Figure 8:
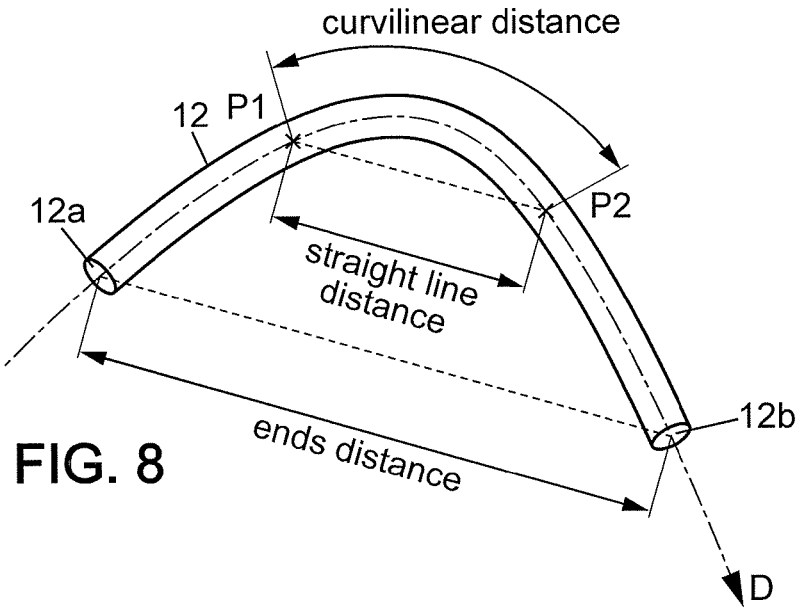
FIG. 8 is a detailed view of a conductor element belonging to the device according to anyone of the embodiments.

As represented on FIG. 8, the first end 12*a* and the second end 12*b* belonging to each conductor element 12 are distant from each other of an ends distance higher than a sub-wavelength λ/10. The wavelength λ is the wavelength inside the dielectric material of the medium 11.

The first and second ends are distant. Contrary to a loop conductor, the conductor elements 12 do not create a significant electric capacitive effect.

The conductor element 12 has a form so that: if first and second points P1, P2 belonging to said conductor element 12 are distant from each other of a curvilinear distance along the conductor element 12 higher than λ/2 or λ/4, then a straight line distance between said first and second points is higher than λ/10.

A portion of the conductor element 12 between first and second points P1, P2 do not form a loop. Contrary to a loop conductor, the conductor elements 12 do not create a significant electric inductive effect.

The conductor elements 12 do not behave as an electric LC resonator having a resonance frequency corresponding to the wavelength λ of the electromagnetic wave.

Thanks to the form of the conductor elements 12, substantially as a linear or arched wire, the device for receiving and/or emitting an electromagnetic wave is compact in size along transversal or lateral directions X, Y perpendicular to the direction D.

The conductor elements 12 are close to each other in the lateral direction X, Y, two neighbour conductor elements being spaced apart from each other of a distance lower than λ/2. The electromagnetic field and the resonance of each conductor element 12 are coupled to the electromagnetic field and the resonance of the neighbour conductor element, therefore providing complex TEM modes.

The invention claimed is:

1. A device for receiving or emitting an electromagnetic wave having a free space wavelength $\lambda_0$ between 1 mm and 1 m, comprising:

a medium of solid dielectric material having at least a substantially planar first surface, the free space wavelength $\lambda_0$ corresponding to a wavelength λ inside said medium, a plurality of conductor elements incorporated inside said medium, each conductor element being a wire of a predetermined length extending along a direction intersecting said first surface between a first end in proximity to said first surface and a second end away from said first surface, and two neighbour conductor elements being spaced apart from each other by a distance less than λ/10, wherein the second end being distant from the first end by a distance greater than λ/10, and wherein the conductor elements comprises a first point and a second point that are distant from each other by a curvilinear distance along the conductor element greater than λ/4, said first and second point being also distant from each other by a straight line distance greater than λ/10, at least one antenna element intended to be connected to an electronic device for receiving or emitting an electric signal, wherein at least one tuned conductor element among the conductor elements has its first end at a distance from said antenna element which is less than λ/10, and said tuned conductor element has a length $H_{wire}$ adapted to generate an electromagnetic resonance along said tuned conductor element corresponding to said wavelength λ.

2. The device according to claim 1, having a plurality of transverse electromagnetic modes inside said medium which have electric and magnetic vectors extending along said first surface, and which have a propagation vector extending along said direction, wherein said plurality of transverse electromagnetic modes have a medium resonance frequency corresponding to said wavelength λ.

3. The device according to claim 2, wherein said antenna element is positioned proximal to at least one antinode of the transverse electromagnetic modes of said medium.

4. The device according to claim 1, further comprising another antenna element intended to be connected to said electronic device for receiving or emitting another electric signal, the other antenna element being different than the antenna element, and the other electric signal being different than the electric signal, wherein said tuned conductor element has its first end at a distance from said other antenna element which is less than λ/10.

5. The device according to claim 1, having a plurality of transverse electromagnetic modes inside said medium which have electric and magnetic vectors extending along said first surface, and which have a propagation vector extending along said direction, wherein said plurality of transverse electromagnetic modes have a medium resonance frequency corresponding to said wavelength λ, and further comprising another antenna element intended to be connected to said electronic device for receiving or emitting another electric signal, the other antenna element being different than the antenna element, and the other electric signal being different than the electric signal, wherein said tuned conductor element has its first end at a distance from said other antenna element which is less than λ/10, and wherein said antenna element is positioned proximal to at least one antinode of the transverse electromagnetic modes of said medium and said other antenna element is positioned proximal to at least another antinode of the transverse electromagnetic modes of said medium, the antinode and other antinode belonging to different modes of the transverse electromagnetic modes.

6. The device according to claim 1, wherein said antenna element is one of the conductor elements.

7. The device according to claim 1, wherein said antenna element is a conductor of an electronic board substantially in close proximity with said first surface.

8. The device according to claim 1, wherein said length $H_{wire}$ is between $0.7 \cdot N \cdot \lambda/2$ and $N \cdot \lambda/2$, where N is a natural integer.

9. The device according to claim 1, wherein said length $H_{wire}$ is substantially equal to $N \cdot \lambda/2$, where N is a natural integer.

10. The device according to claim 1, further comprising another tuned conductor element among the conductor elements, said other tuned conductor element being different than the tuned conductor element, and wherein said other tuned conductor element has its first end at a distance from said antenna element which is less than λ/10, and said other tuned conductor element has another length $H_{wire}$* adapted to generate an electromagnetic resonance along said other tuned conductor element corresponding to another wavelength λ*, the other wavelength λ* being different than the wavelength λ, so that said antenna element is able to receive or emit simultaneously electromagnetic waves of said wavelength λ and of said other wavelength λ*.

11. The device according to claim 1, wherein the direction is a straight line, so that the active conductor element is a linear wire extending along said direction.

12. The device according to claim 1, wherein the medium comprises a second surface, said second surface being substantially planar, intersecting said direction and not being parallel to said first surface, so that said medium has a bevel shape and the conductor elements incorporated inside said medium have a plurality of lengths adapted to a range of wavelengths.

13. The device according to claim 12, wherein the direction is an arched direction between said first surface and said second surface, and comprising a centre of arc, so that the conductor elements that are near said centre of arc have a shorter length than the other conductor elements.

14. The device according to claim 1, further comprising another tuned conductor element among the conductor elements, said other tuned conductor element being different than the tuned conductor element, and wherein the other tuned conductor element has its first end at a distance from said antenna element which is less than $\lambda/10$, and the other tuned conductor element comprises a dielectric layer covering said other tuned conductor element adapted to generate an electromagnetic resonance along said other tuned conductor element corresponding to another wavelength $\lambda^*$, the other wavelength $\lambda^*$ being different than the wavelength $\lambda$, so that said antenna element is able to receive or emit simultaneously electromagnetic waves of said wavelength $\lambda$ and of said other wavelength $\lambda^*$.

15. The device according to claim 1, wherein the medium comprises holes modifying the refractive index of the medium.

16. The device according to claim 1, wherein the first ends of the conductor elements are regularly spaced inside said first surface, forming a periodic pattern inside said first surface.

17. The device according to claim 1, wherein the medium further comprises lateral surfaces extending around said medium from the first surface and substantially along the direction, and wherein said lateral surfaces are covered with a conductive material.

18. The device according to claim 1, wherein each first end of the conductor element is connected to an electric charge selected from an electric mass, a constant electric potential, a passive impedance, a resistance impedance, a capacitor impedance, and an inductor impedance.

19. The device according to claim 1, wherein the curvilinear distance is greater than $\lambda/2$.

20. A system comprising a device for receiving or emitting an electromagnetic wave according to claim 1, wherein the antenna element is connected to an electronic device for receiving or emitting an electric signal representative to said electromagnetic wave.

* * * * *